United States Patent [19]

Kosaka et al.

[11] Patent Number: 4,836,529

[45] Date of Patent: Jun. 6, 1989

[54] SORTING MACHINE

[75] Inventors: Kenji Kosaka, Naka; Yoshikazu Yasu, Katsuta, both of Japan

[73] Assignee: Ikegami Tsushinki Co., Ltd., Tokyo, Japan

[21] Appl. No.: 90,506

[22] Filed: Aug. 28, 1987

[30] Foreign Application Priority Data

Sep. 9, 1986 [JP] Japan ..... 61-210671
Sep. 9, 1986 [JP] Japan ..... 61-210672
Sep. 9, 1986 [JP] Japan ..... 61-137364

[51] Int. Cl.[4] ..... B65H 39/11

[52] U.S. Cl. ..... 271/296; 271/300; 271/303

[58] Field of Search ..... 271/296, 297, 294, 287, 271/288, 289, 290, 292, 293, 300, 302, 303, 188; 74/84 R, 37

[56] References Cited

U.S. PATENT DOCUMENTS

| | | | |
|---|---|---|---|
| 3,372,922 | 3/1968 | Snellman et al. | 271/296 |
| 3,414,254 | 12/1968 | Snellman et al. . | |
| 3,788,631 | 1/1974 | Aldous | 267/156 |
| 4,171,109 | 10/1979 | Roe | 267/156 X |
| 4,209,081 | 6/1980 | Murro | 267/156 X |
| 4,322,069 | 3/1982 | Mitchell | 271/302 |
| 4,361,320 | 11/1982 | Kikuchi et al. | 271/296 X |
| 4,405,225 | 9/1983 | Perrault | 355/14 R |
| 4,449,813 | 5/1984 | Kikuchi et al. | 271/296 X |
| 4,498,665 | 2/1985 | Watanabe | 271/289 |
| 4,548,403 | 10/1985 | Matsui et al. | 271/302 X |
| 4,561,647 | 12/1985 | Snellman et al. | 271/296 |
| 4,576,371 | 3/1986 | Takahashi et al. | 271/296 |
| 4,580,775 | 4/1986 | Maruyama | 271/293 |
| 4,621,803 | 11/1986 | Johdai et al. | 271/293 |
| 4,635,755 | 1/1987 | Arechaga | 267/157 X |
| 4,647,034 | 3/1987 | Sawa | 271/294 X |

FOREIGN PATENT DOCUMENTS

| | | | |
|---|---|---|---|
| 56-78768 | 6/1981 | Japan | 271/292 |
| 0144052 | 8/1983 | Japan | 271/287 |
| 58-220053 | 12/1983 | Japan | 271/293 |
| 58-220054 | 12/1983 | Japan | 271/293 |
| 0220056 | 12/1983 | Japan | 271/287 |
| 60-82566 | 5/1985 | Japan | 271/287 |
| 62-162464 | 7/1986 | Japan | 271/293 |
| 1248100 | 9/1971 | United Kingdom . | |
| 2168037 | 6/1986 | United Kingdom . | |

OTHER PUBLICATIONS

Nicholas P. Chironis; Mechanisms, Linkages, and Mechanical Controls; 1965; McGraw Hill Book Company; Geneva Drive with Needle Bearing-Mounted Cam Follower.

*Primary Examiner*—Joseph J. Rolla
*Assistant Examiner*—Stephen B. Parker
*Attorney, Agent, or Firm*—Oliff & Berridge

[57] ABSTRACT

A sorting machine has a plurality of trays arranged in a vertical array, a vertical transport belt for transporting a recorded sheet introduced through a feed opening, a discharge unit for discharging the sheet to one of the trays, and a guide member which guides the transported sheet to the discharge unit. The discharge unit is shifted to one of the trays. The recorded sheet transported by the transport belt is held between the transport belt and a spiral spring which is retractile in the transport direction, so that dropping of the sheet by gravity is prevented.

14 Claims, 8 Drawing Sheets

SORTING MACHINE

BACKGROUND OF THE INVENTION

1. FIELD OF THE INVENTION

The present invention relates to a sorting machine, and more particularly to a post-processing sorting machine for selectively sorting and housing recorded sheets from a photocopier or printer.

2. DESCRIPTION OF THE PRIOR ART

A conventional sorting machine is known in which trays are fixed to maintain vertical intervals, respectively, and a recorded sheet fed from a feed opening by a transport mechanism is discharged into a tray selected by a tray selecting mechanism. In another arrangement already known, trays fixed to maintain vertical intervals, respectively, are moved integrally upwardly and downwardly so as to align an entry of a selected tray with a recorded sheet discharge portion so that the recorded sheet is discharged.

Conventional sorting machines in which the trays are fixed, however, have a complex arrangement for discharging a recorded sheet guided from the feed opening to the selected tray through transport mechanism and the tray selecting mechanisim, making the overall machine very costly, creating difficult operation, and preventing easy maintenance and inspectors.

Furthermore, a sorting machine in which the trays are moved integrally requires a complicated mechanism for moving the trays so as to match the timing with the transport mechanism. In cases where a large number of recorded sheets are discharged to the trays, the trays become very heavy so that means for lifting the trays requires a large driving capacity and there are difficulties in achieving high speed in transporting the recorded sheets to the trays.

SUMMARY OF THE INVENTION

It is therefore an object of the present invention to provide a sorting machine that can offer a compact overall design by simplifying the transport mechanism.

It is another object of the present invention to provide a sorting machine that facilitates maintenance and inspections of the transport mechanism.

It is a further object of the present invention to provide a sorting machine that can offer high speed sorting and high storage capacity.

In a first aspect of the present invention, a sorting machine comprises a plurality of trays, transport means for transporting a recorded sheet introduced through a feed opening, discharge means for discharging the recorded sheet that has been transported to one of the plurality of trays, a guide member for guiding the recorded sheet to the discharge means, shifting means for shifting the discharge means and the guide member to the tray into which the recorded sheet is to be discharged, and hold means, being retractile freely in a transport direction of the recorded sheet in response to the transfer of the discharge means, for holding the recorded sheet in position between the hold means and the transport means.

In this first aspect of the present invention, holds means holds the recorded sheet to the transport means while the recorded sheet is being guided to the discharge means by the transport means, so that there is no need to provide a supporting device such as a pinch roller to hold the recorded sheet across substantially the whole transporting range of the transport means as in conventional arrangements. Furthermore, the hold means contracts and elongates freely in the transport direction of the transport means so that, even if the recorded sheet jams in the machine, the recorded sheet can be removed easily.

In a second aspect of the present invention, each of the plurality of trays is disposed upwardly inclined along the discharge direction of the recorded sheet. A coupling member is disposed on each side plate of each tray, and means for freely and detachably fixing each of the plurality of trays through the coupling members is also provided. In this second aspect of the present invention, the trays are freely detachable so that any of the trays can be easily removed from the sorting machine, thereby greatly improving maintenance work.

The above and other objects, effects, features and advantages of the present invention will become more apparent from the following description of preferred embodiments thereof taken in conjunction with the accompanying drawings.

DETAILED DESCRIPTION OF PREFERRED EMBODIMENTS

Figure 1A:
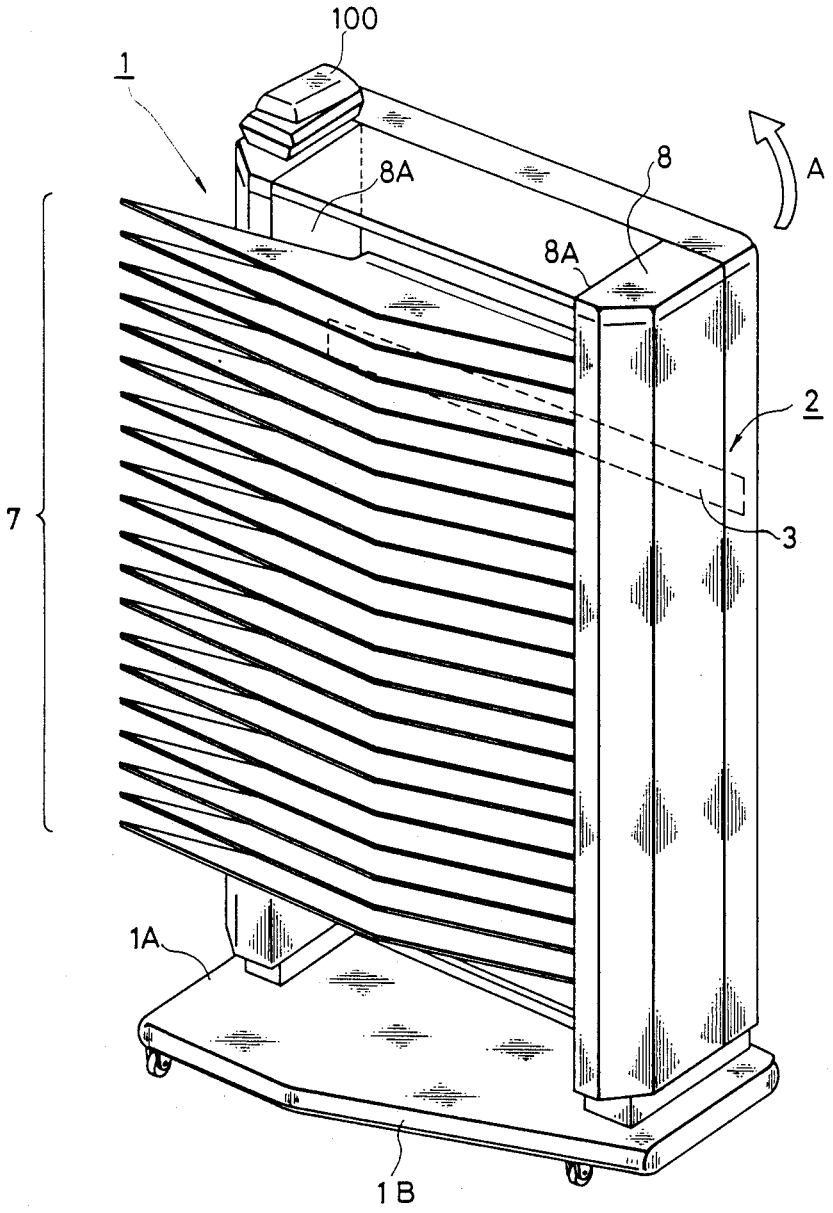
FIG. 1A is a perspective view showing a sorting machine according to the present invention.
Figure 1B:
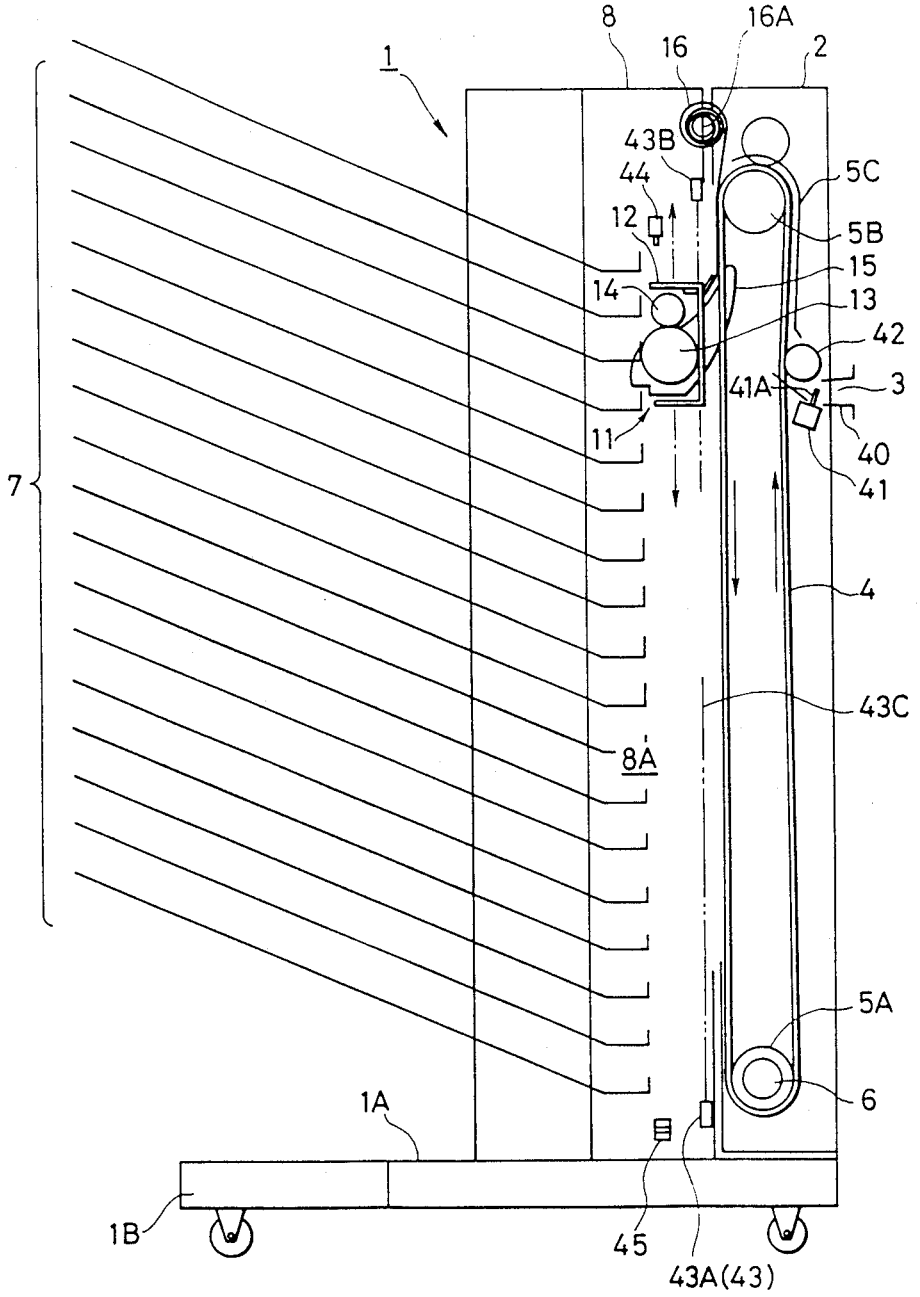
FIG. 1B is a schematic side view showing the principal internal components of the sorting machine shown in FIG. 1A.

FIGS. 1A and 1B show an embodiment of the present invention. Reference numeral 1 denotes a sorting portion composed of the principal components of the main unit. Reference numeral 2 denotes a feed portion having a feed opening 3 and, as shown in FIG. 1B, a transport belt 4, a drive pulley 5A, a follow pulley 5B, a guide plate 5C and a drive motor 6. This feed portion 2 is openable or integrally rotatingly movable in the direction of arrow A around a hinge (not shown). That is, if a jam occurs while the main unit is performing transport or discharge, an opening between the sorting portion 1 and the feed portion 2 can be created by releasing the coupling between them. This makes it extremely simple to perform inspections and to clear any jams. Furthermore, as shown in FIG. 1A, the sorting portion 1 and the feed portion 2 are disposed on a moveable platform 1A. One corner on the sorting portion 1 side of the movable platform 1A is formed into a cut-away portion 1B so as to make it easy for an operator to approach the sorting portion more closely and remove sorted sheets from the trays 7. Reference numeral 100 denotes an electric stapler mounted on the upper portion of an outer-case 8.

Figure 2:
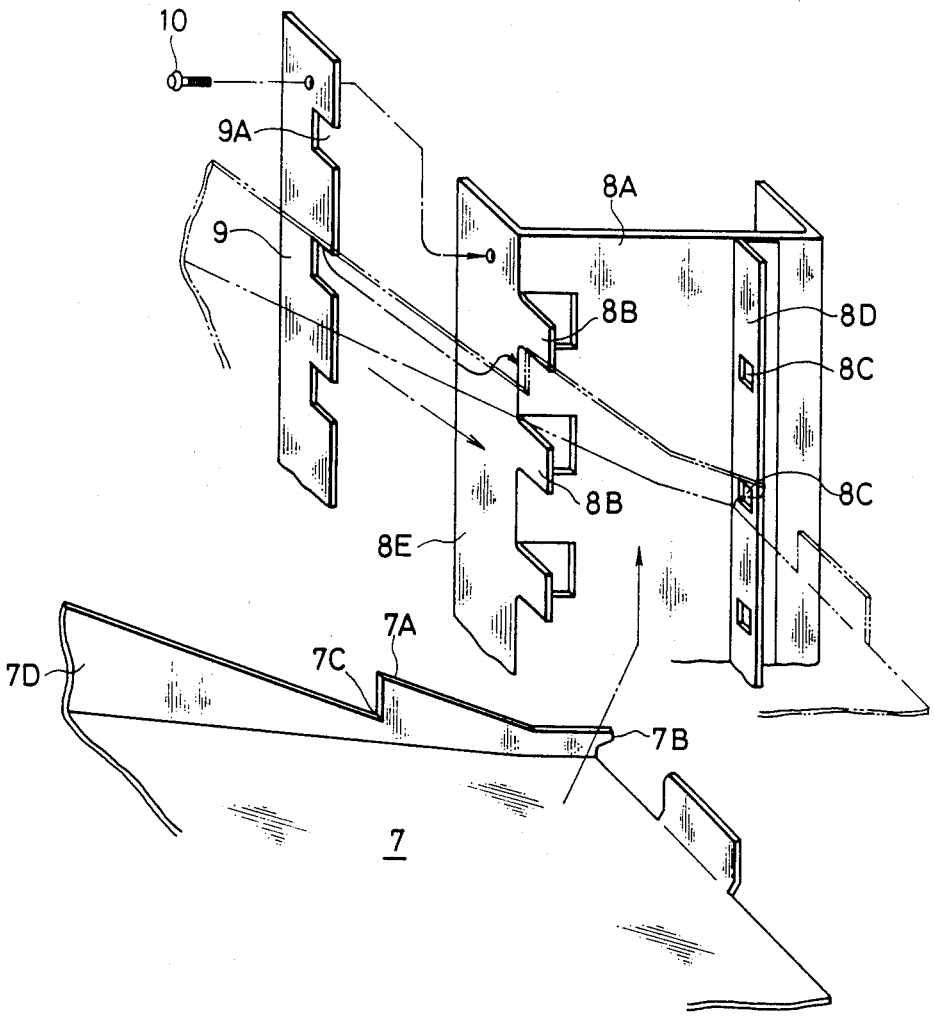
FIG. 2 is a perspective view showing the engaging arrangement of trays in a sorting machine according to the present invention.

FIG. 2 shows an arrangement for fixing the trays 7 to side frames 8A of the outer-case 8. That is, on bent portions 7D on both sides of the tray 7 are formed cog-shaped coupling portions 7A and protrusions 7B. Furthermore, the side frames 8A have a plurality of support plates 8B each formed into a rectangular shape extending from a front plate 8E of a respective side frame 8A. On the side frames 8A are also disposed plates 8D having a plurality of square holes 8C. The positions of the support plates 8B and the square holes 8C are so arranged to each other as to set an attachment angle of the trays 7. Reference numeral 9 is a holding plate having holding notches 9A. The holding plate 9 can be fastened to the fromt plate 8E of the side frame 8A with a screw 10.

To attach a tray, first the protrusions 7B of the tray 7 are inserted into the square holes 8C in the plates 8D on the side frames 8A, then the tray 7 is mounted on top of the rectangular support plates 8B so that the tray 7 is supported in the condition shown by the imaginary line. Once all of the trays 7 are supported in this manner on the side frames 8A, the holding plates 9 are fitted to the front plates 8E. After the trays 7 have been attached so that the top edges of the holding notches 9A couple with the notches 7C formed by the coupling portions 7A of the trays 7, the holding plates 9 are fastened to front plates 8E of the side frames 8A by the screws 10. This restricts the movement of the trays 7 in either direction. When a tray 7 is to be removed or replaced, the holding plates 9 are removed and the tray 7 is pulled out towards the left as shown in FIG. 2.

The explanation of the sorting portion 1 will be continued with reference once more to FIG. 1B. Here, reference numeral 11 denotes a discharge unit supported by a supporting frame 12 so as to be movable upwardly and downwardly. Reference numeral 13 denotes a discharge roller supported pivotally by its shaft on the supporting frame 12, 14 a driven roller kept in contact with the discharge roller 13, and 15 a guide claw member (hereinafter referred to as a claw) for guiding a recorded sheet to the discharge roller 13.

Reference numeral 16 is a spiral spring having a band shape and wound around a rotatable spool 16B rotatably mounted on a shaft 16A supported by a frame. The spiral spring 16 functions so as to rewind with constant force around the rotatable spool 16B on the shaft 16A under its own spring force irrespective of how far it is pulled out. In this embodiment, a plurality of springs 16 are provided around the shaft 16A through spools 16B. The end of each spring 16 is fixed to the support frame 12, so that recorded sheets being transported are held between the straight surface of the pulled out portion of the spring 16 and the surface of the transport belt 4. Furthermore, the surface of the spring 16 has low friction and is finished so as to be smooth, so that a recorded sheet is transported in a downward direction with only the frictional force generated by the transport belt 4. The spiral springs 16 are made of, for example copper base metal material, and by coming into contact with the sheet they remove or discharge static electricity produced on the surface of the sheet. Furthermore, the spiral springs 16 are so formed that, when they are extended, their cross section, as cut perpendicular to the direction of extension, becomes convex to the side on which they come into contact with the sheet, and that they become linear vertically, namely, in the direction of extension as if a metal tape measure was extended. The recorded sheet is deflected by the guide claw 15 so as to be sandwiched between the discharge roller 13 and the driven roller 14, and then discharged into a tray 7.

Figure 3:
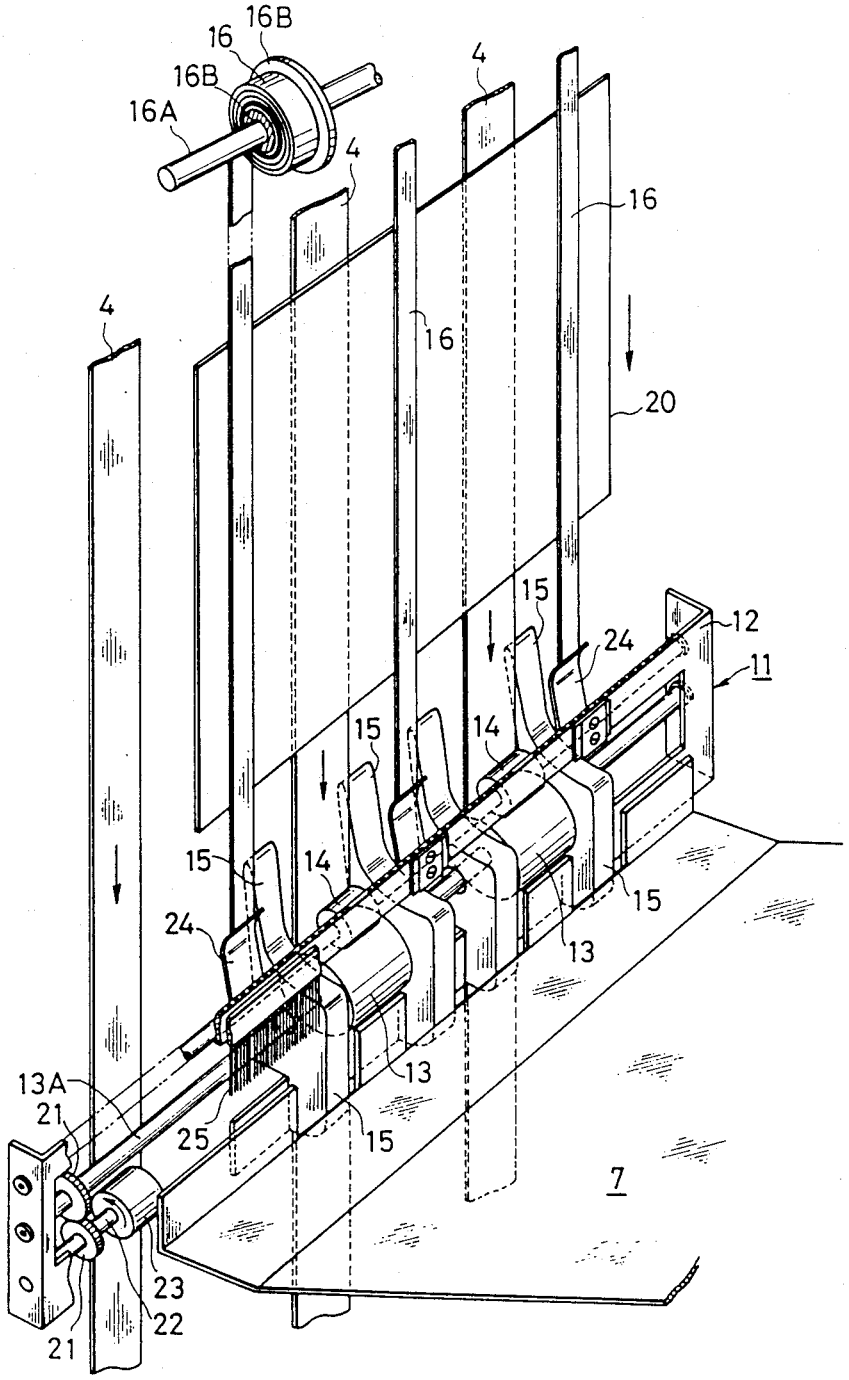
FIG. 3 is a perspective view showing an arrangement of a discharge unit according to the present invention.

FIG. 3 shows the condition in which a recorded sheet 20 transported from above in this manner is discharged into a tray 7 by the discharge unit 11. In FIG. 3, the discharge rollers 13 are driven by a pulley 23 attached to a drive shaft 22 through speed-increasing gears 21 mounted respectively on discharge roller shaft 13A and drive shaft 22. Also, this pulley 23 is driven by one of the transport belts 4 with which it is in contact. Consequently, discharge rollers 13 rotate at a slightly higher speed than the speed of belts 4 so as to prevent jams from occurring. Reference numeral 24 denotes metal fasteners which keep the ends of the spiral springs 16 fastened to the support frame 12 by screws, respectively. The spiral springs 16 are kept along the curved outer faces of the metal fasteners 24, causing the ends of the springs to be fastened to the support frame 12. In the present embodiment, the metal fasteners 24 and the support frame 12 are taken as separate parts, but they may be integrated into a single unit. A static electricity discharge brush 25, disposed on the support frame 12, removes or discharges static electricity from the surface of a sheet being discharged.

Figure 4:
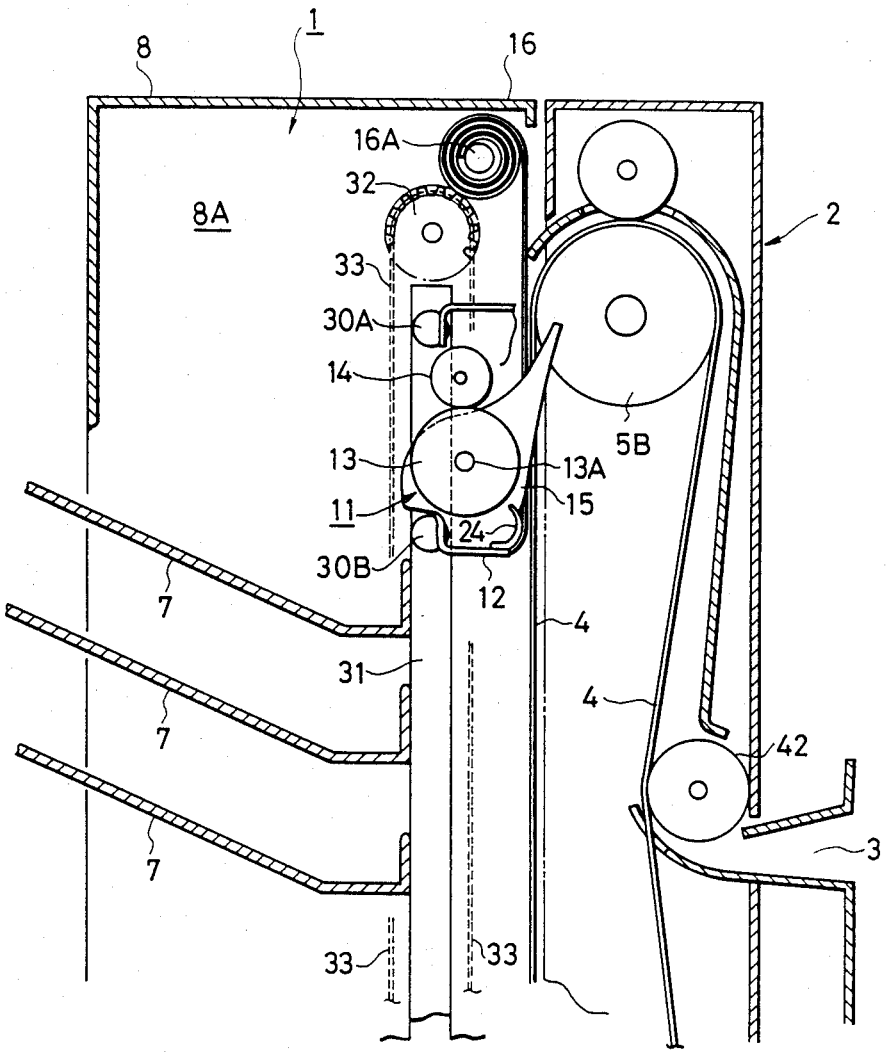
FIG. 4 is a cross-sectional view showing an upper-half portion of a sorting machine according to the present invention.
Figure 5:
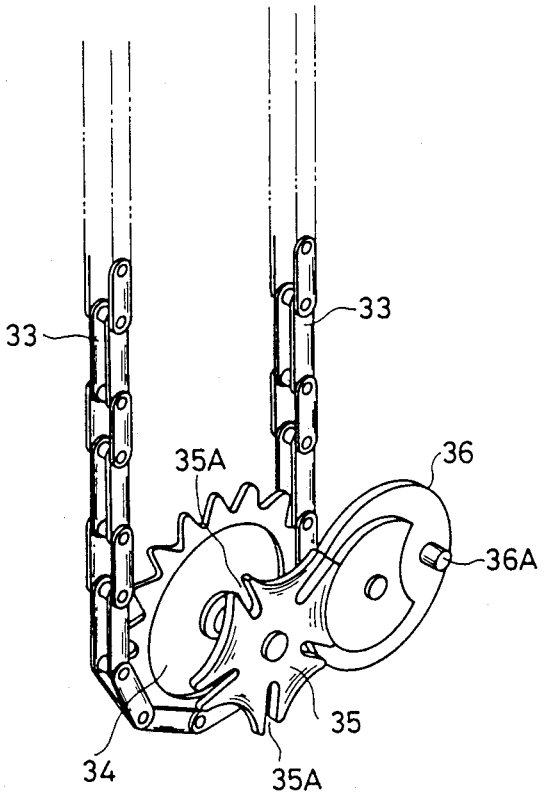
FIG. 5 is a perspective view showing discharge unit shifting means of the present invention.

Next, an explanation will be provided of the means for shifting the discharge unit upwardly and downwardly, and of the means for selecting a tray 7, with reference to FIGS. 4 and 5. As shown in FIG. 4, guide pins 30A and 30B for shifting the unit are disposed on the upper and lower edges of both sides of the discharge unit 11. These pins 30A and 30B are slidably engaged within vertical guide grooves 31 disposed on the side frames 8A of the outer-case 8.

Reference numeral 32 denotes a sprocket supported on a shaft in the vicinity of a side frame 8A, and 33 is a sprocket chain. The sprocket chain 33 and the discharge unit 11 are linked. The drive of the chain 33 can shift the discharge unit 11 intermittently upwards or downwards That is, the sprocket chain 33 is stretched between the sprocket 32 (shown in FIG. 4) and the sprocket 34 (shown in FIG. 5) that is disposed in the lower portion of the sprocket chain 33. In this embodiment, a Geneva wheel 35 having five engaging slots 35A is disposed coaxially with this lower sprocket 34. Furthermore, a Geneva cam 36 having an engaging pin 36A is disposed for intermittently rotating the Geneva wheel 35. When the Geneva cam 36 is driven by a drive motor (not shown), the engaging pin 36A disposed on the Geneva cam 36 engages with one of the engaging slots 35A on the Geneva wheel 35 each time the Geneva cam 36 performs one rotation so that one rotation of the Geneva cam 36 makes 1/5 rotation of the Geneva wheel 35. The sprocket chain 33 is shifted step by step through distances corresponding to that rotation, so that the discharge unit 11 can be shifted upwardly and downwardly in alignment with the intervals at which the trays 7 are disposed. In this embodiment the ratio of moving time to stopping time is 1:4.

Next, an explanation will be provided of the detecting means disposed on the present embodiment of a sorting machine. In FIG. 1B, reference numeral 40 denotes a guide plate disposed on the bottom side of the feed opening 3, and 41 an entry sensor disposed on the guide plate 40. The entry sensor 41 is composed of a photo-interrupter and its light path interceptor, that is a tiltable lever 41A to shut or open the light path. The insertion of a recorded sheet is detected by the entry sensor 41, and then the drive motor 6 is driven. The recorded sheet is sandwiched between the transport belts 4 and the feed rollers 42 and fed. If the light remains intercepted even after the time the sheet takes to pass the detecting position, namely, the time from light interception by sensor 41 to reception once again has exceeded the sufficient time set for the sheet to pass the position, a controller (not shown) judges that a jam has occurred and stops the drive motor 6.

Reference numerals 43A and 43B are light emitter and a light receiver of a discharge detecting sensor 43 for confirming the discharging of the recorded sheet. When a recorded sheet passes across the light path 43C of that sensor 43, its passage is detected by interruption of the light path 43C. Even when the recorded sheet is a material such as a transparent sheet, a tiltable light-shutting lever that can be tilted by the recorded sheet, not shown but disposed on the discharge unit 11, intercepts the light path to permit detection. In this embodiment, the light emitter 43A and light receiver 43B are disposed in the position of the transport belt 4 side of the discharge unit 11, but could also be disposed on the tray entry side of the discharge unit 11.

Reference numeral 44 denotes a sensor for detecting an initial position of discharge unit 11. When the discharge unit 11 reaches an uppermost tray, that is a non-sorting tray, it contacts an actuator of the sensor 44, thereby detecting the initial position. At this time the upward movement of the discharge unit 11 is stopped, and simultaneously all control programs for sorting are returned to their initial conditions.

Reference numeral 45 denotes a sensor disposed in the vicinity of and relative to the Geneva cam 36 for detecting the position of the Geneva cam 36 at each rotation. This sensor 45 can be arranged, for example, in combination with a light-shutting plate disposed on a portion of the Geneva cam 36 and a photo interrupter whose light path can be intercepted by this light-shutting plate. In this way, an output signal from the above-mentioned sensor 45 confirms that the discharge unit 11 has shifted to the tray entry at the next level, and the feed operation for a next recorded sheet can continue.

Figure 6A:
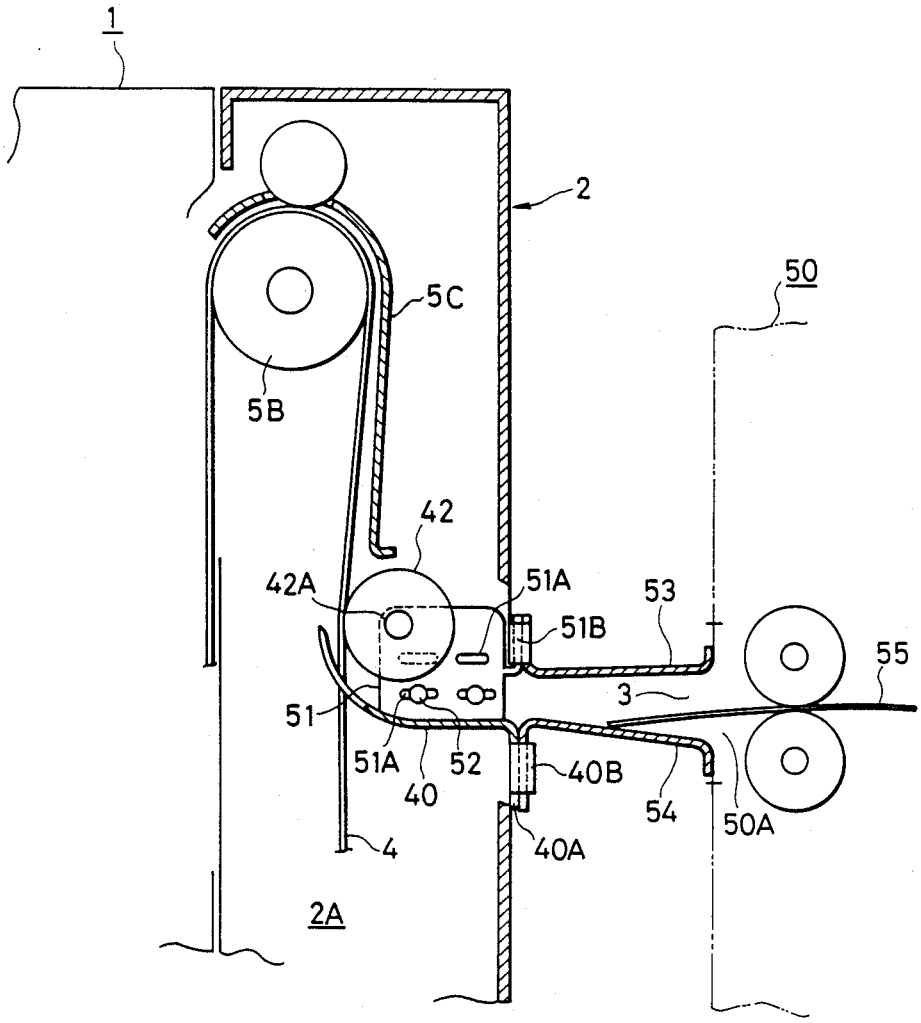
FIG. 6A is a cross-sectional view showing a feed portion of the present invention.
Figure 6B:
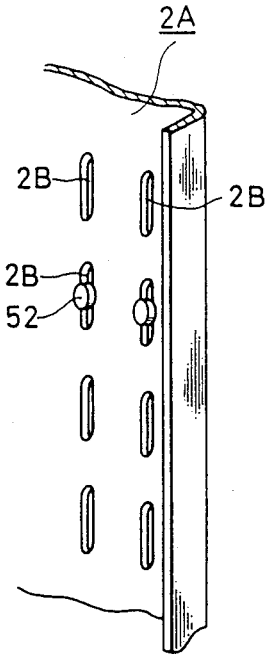
FIG. 6B is a perspective view showing a side plate of the feed portion shown in FIG. 6A.

Next, a more detailed explanation will be made of the feed portion 2 with reference to FIGS. 6A and 6B. A position of the feed opening 3 of the sorting machine is arranged so as to be finely adjustable upwardly and downwardly. Consequently, it is possible, for example, to adjust the height of the feed opening 3 appropriately in accordance with the height of the feed outlet 50A of the photocopier 50. Moreover, as described above, the feed rollers 42 are so arranged as to be pressed into contact with the transport belts 4, so as to be driven by the belts 4.

In this embodiment, a lower guide plate 40 and a shaft support plate 51 supporting a shaft 42A of the feed rollers 42 are formed integrally fromed integrally from the same metal plate. Consequently, the shaft support plate 51 and a side plate 2A of the feed portion 2 are joined and can be fastened by a bolt 52. Reference numeral 51A denotes a horizontally elongated hole formed in the shaft support plate 51, and, as shown in FIG. 6A, four of these holes 51A are disposed on each shaft support plate 51. On the other hand, as shown in FIG. 6B, four vertically elongated attaching holes 2B are disposed in each of two vertical rows on the side plate 2A. Accordingly, the combination of the horizontally elongated holes 51A and the vertically elongated attaching holes 2B makes it possible to adjust appropriately the positions of the feed rollers 42, and at the same time the horizontal and vertical positions of the lower guide plate 40, with the bolts 52.

Furthermore, a coupling portion 51B, that fixes a feed entry upper plate 53, is formed integrally with the shaft support plate 51. A coupling portion 40B, that fixes a feed entry lower plate 54, is formed integrally with the outer plate 40A which is formed by bending the lower guide plate 40. In this way, it is possible to adjust the feed arrangement from the feed opening 3 to the feed rollers 42 both vertically and horizontally in accordance with the fixed position of the shaft support plate 51. Furthermore, it is possible to freely change the shape and the length of the portion of the feed opening 3 that protrudes to the outside, as desired.

Next, an explanation will be made of a sorting operation of this embodiment as arranged above. As shown in FIG. 6A, when a recorded sheet 55 ejected from the photocopier 50 is guided to the feed opening 3, the entry sensor 41 detects the insertion of the recorded sheet 55 as explained with reference to FIG. 1B, and the transport belts 4 are rotated by the transport motor 6. The recorded sheet that is sandwiched between the transport belts 4 and the feed rollers 42 is transported upwardly along the transport belts 4 and the guide plate 5C, is inverted at the position of the upper follow pulley 5B, and is transported downwardly together with the belts 4 while being held between the spiral flat springs 16 and the belts 4.

On the other hand, the discharge unit 11 is moved either upwardly or downwardly from its initial position to align with the spaced array of the trays 7 by the intermittent shifting action explained with reference to FIG. 4 and FIG. 5, that is by the action of the Geneva cam 36, the Geneva wheel 35, and the sprocket chain 33. The discharge unit 11 stops at the position of the selected tray. Then, the above-mentioned recorded sheet that has been transported is guided between the discharge rollers 13 and the follow rollers 14 by the guide claws 15 of the descharge unit 11, finally being discharged to the selected tray by rotation of the discharge rollers 13.

At this time, however, the entry sensor 41 and the sensor 43 monitor whether or not the recorded sheet has been discharged to its tray, making it possible to detect if a jam occurs at either of the positions monitored by these sensors. When the discharge action is completed, the discharge unit 11 shifts again, that shifting being detected by the cam sensor 45. When the shifting is completed, the machine stands by for the discharge of the next recorded sheet.

The above explanation relates to a sorting machine in which the trays are arrayed and fixed so as to maintain a predetermined interval in a vertical direction, but the present invention is not limited to this type of arrangement. The present invention can also be applied to a sorting machine in which the trays are maintained in a stacked condition and their entry portions are shiftable in a vertical direction, or to a sorting machine in which the trays are not arrayed in a vertical direction.

Furthermore, the above embodiment uses a transport belt as the most suitable transport means, but the present invention is not limited to using a transport belt. The present invention can be applied even when, for instance, a transport pulley having a high friction coefficient is used jointly.

What is claimed is:

1. A sorting machine comprising:

a plurality of trays;

transport means for vertically transporting a recorded sheet introduced through a feed opening, said transport means comprising a transport belt for transporting said recorded sheet by friction, drive means for driving said transport belt, a lower guide plate secured on a side plate adjacent to said feed opening for guiding said recorded sheet from said feed opening to said transport belt, and a feed roller rotatably mounted on a shaft which is supported on a shaft support member formed integrally with said lower guide plate, for sandwiching said recorded sheet between said feed roller and said transport belt and feeding said recorded sheet;

discharge means for discharging said recorded sheet to one of said plurality of trays;

guide means for guiding said recorded sheet to said discharge means after transporting by said transport means;

shifting means for shifting said discharge means and said guide means upwardly and downwardly to a tray into which said recorded sheet is to be discharged;

hold means, being retractile in opposite directions along a transport direction of said recorded sheet in response to a shifting of said discharge means, for holding said recorded sheet between said transport means and hold means;

said hold means comprising a spiral spring of elastic strip metal material which has one end wound around a rotatable member rotatably mounted on a shaft and the other end fastened to said discharge means;

said spiral spring functioning so as to rewind with constant force around said rotatable member under its own spring force upon shifting of said discharge means upwardly;

a shaft support member formed integrally with said lower guide plate for rotatably supporting said feed roller; and fixing means for detachably and adjustably fixing said shaft support member to said side plate adjacent to said feed opening in a transport direction of said transport belt, and in a direction so as to make said feed roller contact said transport belt.

2. A sorting machine as claimed in claim 1, further comprising:

an upper plate and a lower plate for forming a guide path for said recorded sheet from an external apparatus to said lower guide plate;

means for detachable fixing said upper plate to said shaft support member; and means for detachably fixing said lower plate to said lower guide plate.

3. A sorting machine as claimed in cläim 1, wherein said shifting means comprising an endless chain linked to said discharge means, a Geneva wheel for driving said chain, and a Gengva cam for rotating intermittently said Geneva wheel.

4. A sorting machine as claimed in claim 1, further comprising:

a coupling member disposed on a side plate of each of said trays; and fixing means for detachable fixing each of said plurality of trays through said coupling member, such that each of said plurality of trays is disposed upwardly inclined along a discharge direction of said recorded sheet.

5. A sorting machine comprising:

a sorting portion;

a feed portion which is openable with respect to said sorting portion;

a plurality of trays disposed on a frame in said sorting portion;

transport means, having an endless transport belt which is disposed in said feed portion, for vertically transporting a recorded sheet introduced through a feed opening;

discharge means, disposed in said sorting portion, for discharging said recorded sheet to one of said plurality of trays, said discharge means comprising a discharge roller mounted on a discharge roller shaft, a pulley mounted on a drive shaft and driven by said transport belt, said pulley being in contact with the exterior surface of said transport belt, and gears engaged with each other and mounted on said discharge roller shaft and said drive shaft, respectively, so that said discharge roller is driven by said transport belt;

guide means for guiding said recorded sheet to said discharge means after transporting by said transport means;

shifting means, disposed in said sorting portion, for shifting said discharge means and said guide means upwardly and downwardly to a tray into which said recorded sheet is to be discharged; and hold means, being retractile in opposite directions along a transport direction of said recorded sheet in response to a shifting of said discharge means, for holding said recorded sheet between said transport means and said hold means;

said hold means comprising a spiral spring of elastic strip metal material which has one end wound around a rotatable member rotatably mounted on a shaft disposed in said sorting portion and the other end fastened to said discharge means;

said spiral spring functioning so as to rewind with constant force around said rotatable member under its own spring force upon shifting of said discharge means upwardly.

6. A sorting machine comprising:

a plurality of trays;

transport means having a plurality of transport belts for vertically transporting a recorded sheet introduced through a feed opening, said transport means comprising transport belts for transporting said recorded sheet by friction, drive means for driving said transport belts, a lower guide plate secured on a side plate adjacent to said feed opening for guiding said recorded sheet from said feed opening to said transport belts, and a feed roller rotatably mounted on a shaft which is supported on a shaft support member formed integrally with said lower guide plate, for sandwiching said recorded sheet between said feed roller and said transport belt and for feeding said recorded sheet;

discharge means for discharging said recorded sheet to one of said plurality of trays;

guide means for guiding said recorded sheet to said discharge means after transporting by said transport means;

shifting means for shifting said discharge means and said guide means upwardly and downwardly to a tray into which said recorded sheet is to be discharged; and hold means for holding said recorded sheet, said hold means being retractile in opposite directions along a transport direction of said recorded sheet in response to a shifting of said discharge means, said hold means comprising a plurality of metal spiral springs each being arranged alternately with each of said transport belts, each of said spiral springs having one end wound around a rotatable member rotatably mounted on a shaft and the other end fastened to said discharge means, said spiral springs functioning so as to rewind with constant force around said rotatable member under their own spring force upon shifting of said discharge means upwardly;

a shaft support member formed integrally with said lower guide plate for rotatably supporting said feed roller; and fixing means for detachably and adjustably fixing said shaft support member to said side plate adjacent to said feed opening in a transport direction of said transport belt, and in a direction so as to make said feed roller contact said transport belt.

7. A sorting machine as claimed in claim 5, wherein said transport means comprises:

a lower guide plate secured on a side plate adjacent to said feed opening for guiding said recorded sheet from said feed opening to said transport belt; and a feed roller, rotatably mounted on a shaft which is supported on a shaft support member formed integrally with said lower guide plate, for sandwiching said recorded sheet between said feed roller and said transport belt and feeding said recorded sheet.

8. A sorting machine as claimed in claim 7, further comprising:

fixing means for detachably and adjustably fixing said shaft support member to said side plate adjacent to said feed opening in a transport direction of said transport belt, and in a direction so as to make said feed roller contact said transport belt.

9. A sorting machine as claimed in claim 8, further comprising:

an upper plate and a lower plate for forming a guide path for said recorded sheet from an external apparatus to said lower guide plate;

means for detachably fixing said upper plate to said shaft support member; and means for detachably fixing said lower plate to said lower guide plate.

10. A sorting machine as claimed in claim 5, wherein said shifting means comprising an endless chain linked to said discharge means, a Geneva wheel for driving said chain, and a Geneva cam for rotating intermittently said Geneva wheel.

11. A sorting machine as claimed in claim 5, further comprising:

a coupling member disposed on a side plate of each of said trays; and fixing means for detachably fixing each of said plurality of trays through said coupling member, such that each of said plurality of trays is disposed upwardly inclined along a discharge direction of said recorded sheet.

12. A sorting machine as claimed in claim 6, further comprising:

an upper plate and a lower plate for forming a guide path for said recorded sheet from an external apparatus to said lower guide plate;

means for detachably fixing said upper plate to said shaft support member; and means for detachably fixing said lower plate to said lower guide plate.

13. A sorting machine as claimed in claim 6, wherein said shifting means comprises an endless chain linked to said discharge means, a Geneva wheel for driving said chain, and a Geneva cam for rotating intermittently said Geneva wheel.

14. A sorting machine as claimed in claim 6, further comprising:

a coupling member disposed on a side plate of each of said trays; and fixing means for detachably fixing each of said plurality of trays through said coupling member, such that each of said plurality of trays is disposed upwardly inclined along a discharge direction of said recorded sheet.

* * * * *